US005538623A

United States Patent [19]

Johnson et al.

[11] Patent Number: 5,538,623

[45] Date of Patent: Jul. 23, 1996

[54] FCC CATALYST STRIPPING WITH VAPOR RECYCLE

[76] Inventors: David L. Johnson, 181 Concord Meeting Rd., Glen Mills, Pa. 19342; Diane V. Jorgensen, #4 Little Brook La., Wilmington, Del. 19807

[21] Appl. No.: 168,355

[22] Filed: Dec. 17, 1993

[51] Int. Cl.[6] ..... C01G 11/00; C01G 45/00; C01G 47/00

[52] U.S. Cl. ..... 208/120; 208/113; 208/153; 208/161; 502/20

[58] Field of Search ..... 208/153, 161, 208/113, 120, 20; 502/20

[56] References Cited

U.S. PATENT DOCUMENTS

| | | | |
|---|---|---|---|
| 3,406,112 | 10/1968 | Bowles | 208/153 |
| 3,412,013 | 11/1968 | Bowles | 208/120 |
| 4,345,992 | 8/1982 | Wisher et al. | 208/120 |
| 4,787,967 | 11/1988 | Herbst et al. | 208/113 |
| 4,917,790 | 4/1990 | Owen | 208/113 |
| 4,988,430 | 1/1991 | Sechrist et al. | 208/113 |
| 5,000,841 | 3/1991 | Owen | 208/113 |
| 5,158,669 | 10/1992 | Cetinkaya | 208/113 |
| 5,237,104 | 8/1993 | Summerlin . | |
| 5,248,408 | 9/1993 | Owen | 208/113 |
| 5,248,411 | 9/1993 | Chan | 208/113 |

*Primary Examiner*—Asok Pal

*Attorney, Agent, or Firm*—Ronald A. Bleeker; Malcolm D. Keen

[57] ABSTRACT

An FCC process and apparatus operates with closed reactor cyclones and a catalyst stripper using H2 or recycled stripper vapor for stripping gas. Preferably stripper vapor is removed, cooled and condensed, and some vapor recycled to the stripper. Isolation of the stripper from the cracked product vapors permits use of large amounts of stripping steam, or stripping gases such as hydrogen.

6 Claims, 2 Drawing Sheets

FCC CATALYST STRIPPING WITH VAPOR RECYCLE

BACKGROUND OF THE INVENTION

1. Field of the Invention

The field of the invention is fluidized catalytic cracking (FCC) in general and catalyst stripping in particular.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts hot, regenerated catalyst. Hot catalyst vaporizes and cracks the feed at 425 C.–600 C., usually 460 C.–560 C. Cracking deposits coke on the catalyst, deactivating it. The cracked products are separated from the coked catalyst. The coked catalyst is stripped of volatiles, usually with steam, in a catalyst stripper and the stripped catalyst is regenerated. The catalyst regenerator burns coke from the catalyst with oxygen containing gas, usually air. Decoking restores catalyst activity and heats the catalyst to, e.g., 500 C.–900 C., usually 600 C.–750 C. This heated catalyst is recycled to the cracking reactor to crack more fresh feed. Flue gas formed by burning coke in the regenerator may be treated for removal of particulates and to burn CO, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, recycled to the reactor in the form of hot catalyst.

Catalytic cracking has undergone progressive development since the 40s. The trend of development of the FCC process has been to all riser cracking and zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite based catalysts of high activity and selectivity are now used in most FCC units. These catalysts work best when coke on the catalyst after regeneration is less than 0.1 wt %, and preferably less than 0.05 wt %.

To regenerate FCC catalysts to low residual carbon levels, and to burn CO completely to $CO_2$ within the regenerator (to conserve heat and minimize air pollution) many FCC operators add a CO combustion promoter to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade poorer quality feeds, in particular, feedstocks that were heavier, and had more metals and sulfur.

These heavier, dirtier feeds pushed the regenerator, and exacerbated four existing problem areas in the regenerator, sulfur, steam, temperature and NOx. These problems will each be reviewed in more detail below.

SULFUR

Much of the sulfur in the feed ends up as SOx in the regenerator flue gas. Higher sulfur feed, and complete CO combustion in the regenerator, increase the SOx content of the flue gas. Some attempts were made to minimize the amount of SOx discharged to the atmosphere by including catalyst additives to capture SOx in the regenerator. These additives pass with the regenerated catalyst back to the FCC reactor where the reducing atmosphere releases the sulfur compounds as $H_2S$. Suitable agents are described in U.S. Pat. Nos. 4,071,436 and 3,834,031. Use of cerium oxide for this purpose is shown in U.S. Pat. No. 4,001,375.

Unfortunately, the conditions in most FCC regenerators are not the best for SOx adsorption. The high temperatures in modern FCC regenerators (up to 870 C. (1600 F.) impair SOx adsorption. One way to minimize SOx in flue gas is to pass catalyst from the FCC reactor to a long residence time steam stripper, as in U.S. Pat. No. 4,481,103 Krambeck et al which is incorporated by reference. This process steam strips spent catalyst at 500–550 C. (932 to 1022 F.), to remove some undesirable sulfur- or hydrogen-containing components, but considerable capital expense is involved.

STEAM

Steam causes catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from the FCC stripper to the regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration. However, the flue gas from both stages of the regenerator contains SOx which is difficult to clean. It would be beneficial, even in staged regeneration, if the amount of water precursors present on stripped catalyst was reduced.

Steaming is more of a problem as regenerators get hotter. High temperatures accelerate the deactivating effects of steam.

TEMPERATURE

Regenerators are operating at higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator runs hotter, so the extra heat may be rejected as high temperature flue gas. Many refiners limit the amount of resid or high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in *Dual-Function Cracking Catalyst Mixtures,* Ch. 12, Fluid Catalytic Cracking, ACS Symposium Series 375, American Chemical Society, Washington, D.C., 1988.

Some regenerator temperature control is possible by adjusting the CO/CO2 ratio in the regenerator. Burning coke partially to CO produces less heat than complete combustion to CO2. However, in some cases, this control is insufficient, and also leads to increased CO emissions, which can be a problem unless a CO boiler is present.

The prior art also used dense or dilute phase regenerator heat removal zones or heat-exchangers remote from, and external to, the regenerator to cool hot regenerated catalyst for return to the regenerator. Such approaches help, but I wanted to reduce the amount of unstripped hydrocarbons burned in the regenerator, rather than deal with unwanted heat release in the regenerator.

NOX

Burning nitrogenous compounds in FCC regenerators makes minor amounts of Nox which are emitted with the regenerator flue gas. Usually these emissions were not much of a problem because of low temperatures and easy to meet regulations on Nox emissions.

Many FCC units now operate at higher temperatures, with a more oxidizing atmosphere, and use CO combustion promoters such as Pt. These changes in regenerator operation which reduce CO emissions, usually increase nitrogen oxides (Nox) emissions. It is difficult in a catalyst regenerator to burn completely coke and CO in the regenerator without increasing the Nox content of the regenerator flue gas, so Nox emissions are now frequently a problem. Higher regenerator temperatures, due in part to burning of potentially strippable hydrocarbons in the regenerator contributes to the Nox problem.

It would be beneficial if a better stripping process were available which would increase recovery of valuable, strippable hydrocarbons. There is a special need to remove more hydrogen from spent catalyst to minimize hydrothermal degradation in the regenerator. It would be further advantageous to remove more sulfur-containing compounds from spent catalyst before regeneration to minimize SOx in the regenerator flue gas. Also, it would be advantageous to have a way to reduce to some extent regenerator temperature.

Although much work has been done on better stripping designs, there are still many shortcomings. We realized that one significant problem was trying to achieve efficient stripping in a stripper which was tied to the FCC reactor and FCC main fractionator. Recovering stripper vapors with cracked products led to efficient fractionation of stripper vapor, but put severe constraints on the process, primarily in the amount of stripping gas and the kind of stripping gas. The constraint on stripping gas volume will be considered first.

Although it may seem easy to improve stripping simply by adding more steam, in practice this is not possible. Simply increasing the stripping steam usually improves stripping, but in some units the net effect is to send much of the increased stripping steam into the regenerator. Simply increasing steam rates may result in dilute phase transport of spent catalyst into the regenerator. Stripping is improved, but primarily because of better settling or deaeration of spent catalyst within or just above the stripper.

There are also problems if the stripping steam goes where it is intended, namely rises with the cracked products. The addition of large amounts of stripping steam adds large volumes of steam to the FCC reactor vessel, the transfer line, and the main column. The steam in the reactor vessel is good and bad. It reduces the residence time of cracked products, and reduces thermal cracking, both are beneficial. The presence of large amounts of steam in the transfer line and FCC main fractionator is bad, because the units are not built to handle such large increases in vapor traffic.

The increased vapor traffic increases the pressure drop through the transfer line and the fractionator, increases reactor pressure and hurts yields. While the main column could simply be made larger, this is not practical in existing units, and is expensive in new units when the size of these columns is considered, many are more than 20' in diameter at the base.

The common practice of mixing stripper vapor and cracked products also forces refiners to use as stripping vapor only vapors which are compatible with the downstream processing equipment. Stripping steam is the preferred fluid, because it condenses intermediate the FCC main column overhead receiver and the wet gas compressor, so increased stripping steam does not translate into an increase in vapor volume to the wet gas compressor. If any other vapor were used, e.g., flue gas, the additional gas would require compression, and handling in a gas treating facility not designed to handle inerts.

In U.S. Pat. No. 4,988,430, which is incorporated by reference, the stripping vapors were isolated from cracked product and processed separately. Much of the FCC unit was conventional—a riser reactor discharged into cyclone separators in a reactor vessel. Cracked products were removed and coked catalyst discharged into a stripper in the reactor vessel. Conventional amounts of stripping steam were added to the stripper. Stripper vapors were removed from the reactor vessel, cooled, condensed, and recycled to the base of the riser reactor for use as a lift gas. While this "recycle" of a portion of the stripper vapors to the base of the riser provides an alternate source of lift gas it does nothing to improve stripping.

We wanted a new approach to catalyst stripping. We wanted better stripping of coked FCC catalyst without increasing vapor traffic to the FCC main column. We wanted to be able to use hydrogen and/or more steam as a stripping gas, but without sending this stripping gas to the main column.

We discovered a way to operate the stripper with recycled stripping vapor. By taking a different approach to stripping, we were able to achieve:

1. Some reduction in reactor pressure which improves reactor selectivity.

2. Cooler regenerated catalyst, permitting "windup" of the FCC unit to increase conversion.

3. Drier regenerator operation, reducing catalyst hydrothermal deactivation.

4. Increased liquid yields, recovering strippable hydrocarbons rather than burning them in the regenerator.

Our new stripping process and apparatus not only improves stripping, it reduces the load on the catalyst regenerator, minimizes SOx emissions, and permits processing of difficult feeds. Regenerator temperatures can be increased, reduced, or maintained constant while processing worse feeds, by reducing hydrothermal deactivation of catalyst in the regenerator.

BRIEF SUMMARY OF THE INVENTION

Accordingly, the present invention provides a fluidized catalytic cracking process wherein a heavy hydrocarbon feed comprising hydrocarbons having a boiling point above about 650 F. is catalytically cracked to lighter products by contact with a circulating fluidizable catalytic cracking catalyst inventory consisting of particles having a size ranging from about 20 to about 100 microns, comprising catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons; discharging said effluent mixture into a closed cyclone separation means within a reaction vessel to produce a cracked product rich vapor phase and a solids rich phase comprising spent catalyst; removing said cracked product rich vapor phase from said vessel via a vapor transfer conduit passing through, and fluidly isolated from, a dilute phase, upper region of said reaction vessel; discharging from said separation means a solids rich spent catalyst phase down into a stripping means in a lower portion of said reaction vessel; said stripping means having at least one inlet in a lower portion thereof for stripping vapor, an outlet in a lower portion thereof for stripped catalyst, and an outlet in an upper portion thereof for stripper effluent vapor; stripping said spent catalyst in said stripping means by contact with stripping vapor to produce stripper effluent vapor and stripped catalyst; removing said stripper effluent vapor from said reactor vessel by a stripper effluent vapor transfer line connective with said dilute phase region of said reactor vessel; recycling at least a portion of said stripper effluent vapor to said stripping means to provide at least a portion of said stripping vapor; removing stripped catalyst from a lower portion of said stripping means and transporting said stripped catalyst via a catalyst transfer line to a catalyst regeneration means; regenerating stripped catalyst in a catalyst regeneration means at catalyst regeneration conditions to produce regenerated catalyst; and recycling said regenerated catalyst from said regeneration means to said catalytic cracking reactor.

In another embodiment, the present invention provides a fluidized catalytic cracking process wherein a heavy hydrocarbon feed comprising hydrocarbons having a boiling point above about 650 F. is catalytically cracked to lighter products by contact with a circulating fluidizable catalytic cracking catalyst inventory consisting of particles having a size ranging from about 20 to about 100 microns, comprising catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons; discharging said effluent mixture into a closed cyclone separation means within a reaction vessel to produce a cracked product rich vapor phase and a solids rich phase comprising spent catalyst; removing said cracked product rich vapor phase from said vessel via a vapor transfer conduit passing through, and fluidly isolated from, a dilute phase, upper region of said reaction vessel; discharging from said separation means a solids rich spent catalyst phase down into a stripping means in a lower portion of said reaction vessel; said stripping means having: a hydrogen inlet in an upper portion thereof for hydrogen containing stripping gas, a steam inlet in a lower portion thereof for stripping steam, an outlet in a lower portion thereof for stripped catalyst, and an outlet in an upper portion thereof for stripper effluent vapor; stripping said spent catalyst in said stripping means by contact with stripping vapor to produce stripper effluent vapor and stripped catalyst; removing said stripper effluent vapor from said reactor vessel by a stripper effluent vapor transfer line connective with said dilute phase region of said reactor vessel; recycling at least a portion of said stripper effluent vapor to said hydrogen inlet of said stripping means; removing stripped catalyst from a lower portion of said stripping means and transporting said stripped catalyst via a catalyst transfer line to a catalyst regeneration means; regenerating stripped catalyst in a catalyst regeneration means at catalyst regeneration conditions to produce regenerated catalyst; and recycling said regenerated catalyst from said regeneration means to said catalytic cracking reactor.

In an apparatus embodiment, the present invention provides an apparatus for the fluidized catalytic cracking of a hydrocarbon feed comprising a riser catalytic cracking reactor means having an inlet in a base portion thereof connective with a source of feed and with a source of regenerated catalyst and an outlet in an upper portion within a vessel, said outlet discharging cracked products and spent cracking catalyst containing coke and strippable hydrocarbons; a cyclone separator within said vessel connected to said riser reactor outlet for producing a cracked product rich vapor phase and a solids rich phase of spent catalyst and strippable hydrocarbons which is discharged down via a cyclone dipleg; a stripping means having: a recycled stripping gas inlet in an upper portion thereof for a recycled stripping gas stream, a steam inlet in a lower portion thereof for stripping steam, a stripped catalyst outlet in a lower portion thereof for stripped catalyst, and at least one stripper vapor outlet in an upper portion thereof for stripper effluent vapor; a stripped catalyst transport means for transferring catalyst discharged from said stripping means to a catalyst regeneration means; a catalyst regeneration means having a stripped catalyst inlet connective with said transport means; a regeneration gas inlet; a flue gas outlet, and an outlet for removal of regenerated catalyst; a catalyst recycle means connective with said outlet of said catalyst regeneration means and said catalyst inlet of said cracking reactor; a stripper effluent vapor recycle means having an inlet receiving stripper vapor from said stripping means and a vapor recompression and recycle means for recycle of at least a portion of said stripper effluent vapor to said recycled stripping gas inlet in said stripping means.

DETAILED DESCRIPTION

Description of Preferred Embodiments

Figure 1:
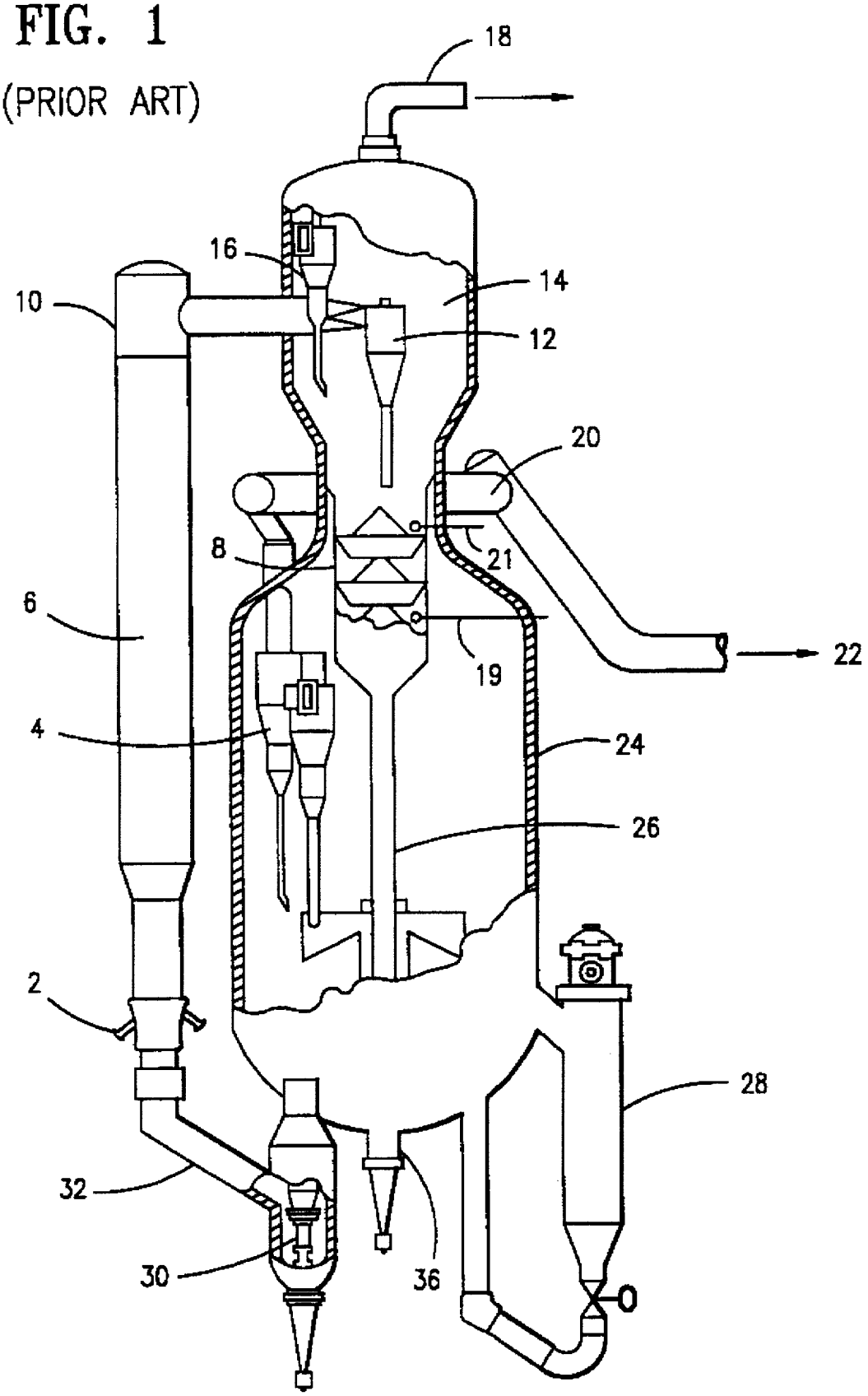
FIG. 1 (PRIOR ART)
FIG. 1 (Prior Art) shows a simplified schematic view of an FCC unit with a conventional stripper.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil or vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually removed via upper cyclones 16 and sent via conduit 18 to the fractionator.

Spent catalyst is discharged down from a dipleg of riser cyclones 12 into catalyst stripper 8, where one, or preferably 2 or more, stages of steam stripping occur, with stripping steam admitted via lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled using spent catalyst plug valve 36.

This stripper design is one of the most efficient strippers used in modern FCC units, due in large part to its generous size. Most riser reactor FCC's have strippers disposed as annular beds about the riser reactor, and do not provide as much cross sectional area for catalyst flow as does the design shown in FIG. 1.

Catalyst is regenerated in regenerator 24 with air, added via air lines and an air grid distributor not shown. Catalyst cooler 28 allows heat to be removed from the regenerator, if desired. Regenerated catalyst is withdrawn from the regenerator via regenerated catalyst plug valve assembly 30 and discharged via lateral 32 into the base of riser reactor 6 to crack fresh feed injected via injectors 2. Flue gas, and some entrained catalyst discharge into a dilute phase region in the upper portion of regenerator 24. Entrained catalyst is separated from flue gas in multiple stages of cyclones 4, and discharged 8 into plenum 20 for discharge to the flare via line 22.

Figure 2:
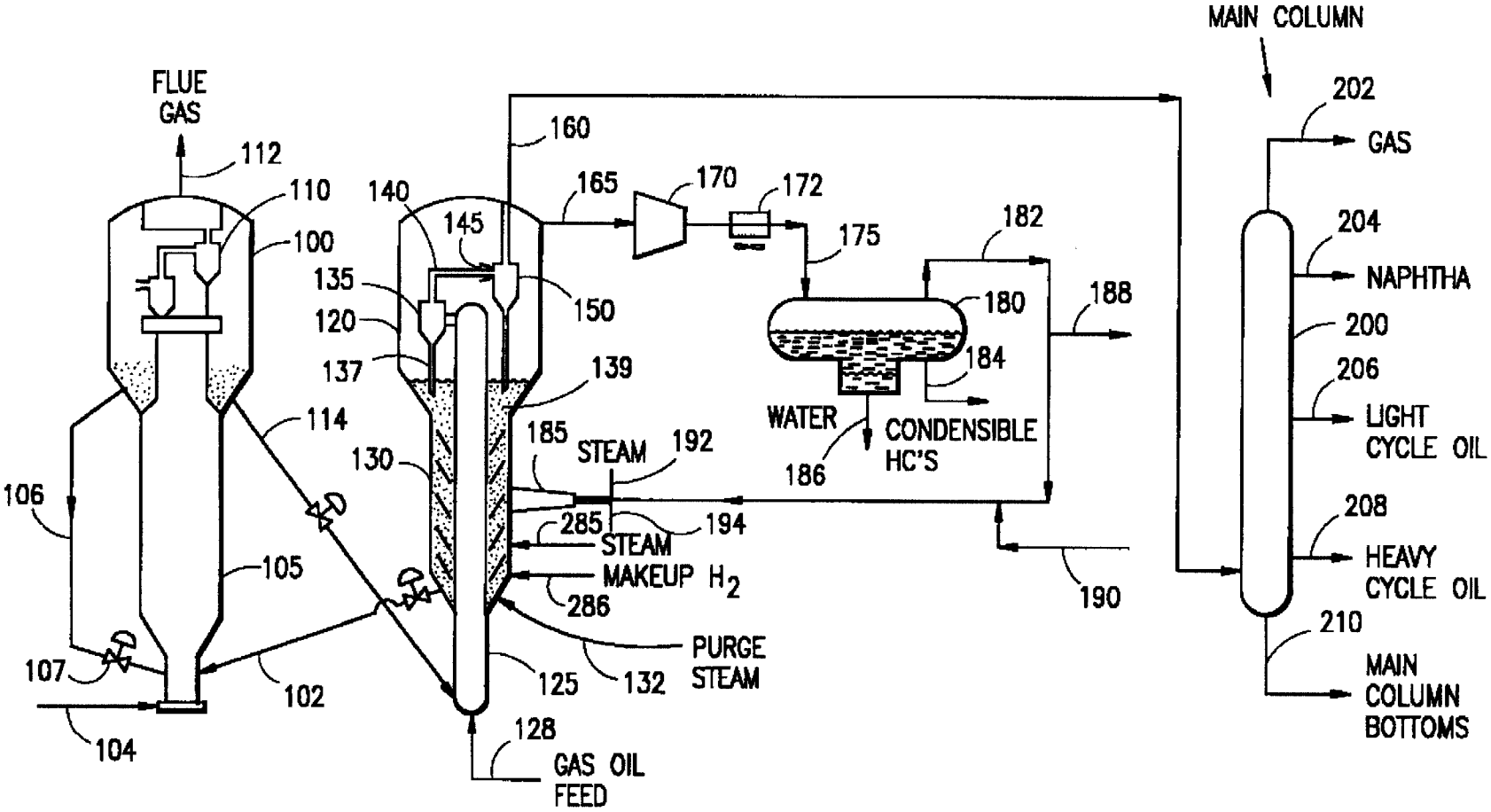
FIG. 2 (Invention) shows an evacuated stripper with vapor recycle.

In FIG. 2 (invention) a side by side model FCC unit is shown, with a stripper vapor recycle capability. The regenerator 100 is high efficiency regenerator, with a fast fluidized bed coke combustor 105 receiving spent catalyst via line 102 and some recycled regenerated catalyst via line 106, with the flow controlled by valve 107. Regeneration air is added via line 104. Regenerated catalyst and flue gas are discharged into an upper portion of the regenerator, and separated via cyclone assembly 110 into a flue gas stream withdrawn via line 112 and a regenerated catalyst stream charged via line 114 to the base of the riser reactor 125.

Fresh feed is added via line 128 to the base of the riser reactor 125, where it mixes with the hot regenerated catalyst. The mixture passes up the riser, and spent catalyst and cracked products are discharged into a closed cyclone 135 at the riser outlet. The cyclone rapidly separates cracked products from spent catalyst, with cracked products removed via vapor outlet 140. This vapor enters secondary cyclone 150 via an enlarged inlet horn 145 which encompasses the vapor outlet line 140 and provides a small annular space shown in the Figure for thermal expansion and to permit vapor traffic. Cracked products are removed from vessel 120 via line 160 and charged to the FCC main column 200. Cracked products are fractionated into a normally gaseous stream removed via line 202, a naphtha fraction removed via line 204, a light cycle oil (LCO) fraction in line 206, a heavy cycle oil (HCO) fraction in line 208, and a main column bottoms stream, sometimes called a slurry oil removed via line 210.

The spent catalyst recovered by the primary cyclone 135 is discharged down via cyclone dipleg 137 which is sealed by immersion in bed 139. This bed is the top of the stripper 130, containing a plurality of chevron plates or baffles to provide for countercurrent stripping of spent catalyst with stripping steam added via line 132.

This much of the stripper is conventional. What is different in the present invention is adding to the stripper a recycle gas stream via line 182, and/or removal of much or all of the stripper vapor via line 165 from vessel 120. The removal circuit will be discussed first.

Much or all of the stripper vapor is removed via line 165, rather than via line 160. There are two distinct vapor streams in the vessel 120. The largest is the cracked vapor product exiting from the riser reactor. This comprises a spectrum of cracked products, and a minor amount of steam, typically 1–3 wt % steam added with the oil feed to aid in feed atomization. The other stream in vessel 120 is the mixture of stripping fluid and desorbed cracked vapor and/or reaction products of stripping. This is a much smaller stream with a lower molecular weight than the cracked product in line 160. When steam, a preferred stripping fluid, is used, there will usually be more steam than cracked product. When hydrogen rich gas or a portion of the gas in line 202 (or from the gas plant processing this gas) is used as a stripping medium the molecular weight of the fluid in line 165 will usually be less than ½ that of the fluid in line 160.

The stripper effluent vapor removal may be augmented by use of compressor 170, which may be steam or electric driven. The vapor may be cooled by means not shown upstream of compressor. The compressed fluid is discharged from the compressor, preferably passed through a cooling means such as fin fan cooler 172 or heat exchanged with some other process stream, and charged to three phase separator 180. Normally gaseous hydrocarbons are withdrawn via line 182, while liquid hydrocarbons are removed via line 184. The condensed water is withdrawn from the boot of the separator via line 186.

Some of the vapor phase in line 188 may be continuously or periodically removed via line 188, and charged to a flare, added to the refinery fuel gas stream, or charged to a gas concentration plant. Some makeup fluid, such as a hydrogen rich stream, may be continuously or intermittently added via line 190. Most or all the vapor stream in line 182 is recycled back into the stripper, preferably via optional steam jet ejector 185. Steam added via lines 192 and 194 can provide much or all of the motive force needed to drive recycle vapor back into the stripper. In some embodiments, all the stripping steam may be added via the steam jet ejector, reducing or even eliminating the need for compressor 170. Additional steam may be added via line 285, while hydrogen or other stripping gas may be added via line 286, if desired.

Now that the invention has been reviewed in connection with the embodiments shown in FIG. 2, a more detailed discussion of the different parts of the process and apparatus of the present invention follows. Many elements of the present invention can be conventional, such as the cracking catalyst, so only a limited discussion of such elements is necessary.

FCC FEED

Any conventional FCC feed can be used. The process of the present invention is especially useful for processing difficult charge stocks, those with high levels of CCR material.

FCC CATALYST

Conventional FCC catalyst may be used. The catalyst may contain ZSM-5. Many design problems can be avoided by using conventional sized particles, e.g., there is no concern that large particles of ZSM-5 will be trapped in the regenerator. Design and operation of the stripper are also simplified if the catalyst has a conventional particle size distribution, with an average particle size of around 60–80 microns.

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds, and riser top temperatures of 900 to 1200 F., preferably 950 to 1050 F.

The FCC reactor conditions, per se, are conventional and form no part of the present invention.

CATALYST STRIPPING

Conventional stripping conditions can be used, but are not the best use of the present invention. When conventional amounts of stripping steam are used, the design of the closed cyclone system is simplified (e.g., no annular gap need be provided at any cyclone inlet, all stripping vapor can be removed separately from the cracked products) and stripping vapor traffic through the cyclone, transfer line and main column is essentially eliminated. This allows pressure to be reduced somewhat in the reactor, improving yields.

Preferably refiners will use our apparatus and what would be considered excessive amounts of stripping vapor and/or stripping vapors which could not readily be used in conventional FCC units.

Operation with large amounts of stripping vapor, expressed as wt % steam, in the stripper will improve stripping but not degrade other facets of the FCC operation. When steam is used, in large amounts, say 5 to 10 wt % of fresh feed, much better stripping of catalyst may be achieved. The increased stripping steam will not increase catalyst entrainment to the FCC main column, as little or none of the stripping vapor exits with cracked products going to the main column. The vapor traffic in the upper portions of vessel 120 need not increase at all, as these vessels are typically sized to accommodate say 5 to 10% of the cracked vapor product. If catalyst entrainment is a problem, a small cyclone, not shown, may be added to the inlet to line 165 to remove entrained catalyst to a tolerable level.

One of the most beneficial uses of the present invention involves unconventional stripping gases such as H2 or H2 rich streams. Refiners have known for years that hydrogen could be used to remove some coke from catalyst, see e.g., U.S. Pat. No. 3,412,013 Bowles, Regenerating a Cracking Catalyst by Hydrogen and Oxygen Treatment, which is incorporated by reference. Hydrogen removes coke from spent catalyst. Hydrogen also suppresses coke formation in metal vessels operating at high temperatures in the presence of hydrocarbon, and for this reason hydrogen is added to some heavy oil streams at the inlet to a furnace, to minimize fouling of the heater by coke formation.

Refiners have known for years hydrogen was beneficial, but have never devised a way to make practical use of it in an FCC stripper. Much of the difficulty is the current FCC design, which usually sends all stripper vapors directly or indirectly to the main fractionator.

If a non-condensible gas such as hydrogen were used for stripping, the gas plant would have difficulty dealing with it. The FCC wet gas compressor may also have trouble moving this gas to the gas plant, because the presence of so much hydrogen reduces gas density and to some extent the effectiveness of conventional centrifugal compressors.

In contrast, now refiners can operate the stripper independently of the FCC main column and gas plant. They can add too much stripping steam, without changing the volume of vapor sent to the main column. They can use hydrogen to strip hydrocarbons, and increase recovery of liquid hydrocarbons, without disrupting the operation of the gas plant or wet gas compressor. Liquid hydrocarbons recovered from the stripper recycle gas separator can be sent to the FCC main column (or elsewhere) without sending normally vaporous hydrocarbons or hydrogen or stripping steam) to the main column.

Pressure in the stripper vessel can be reduced, which in itself will improve stripping. Pressure can be reduced until there is a trace of reverse flow in closed cyclone systems such as that shown in the Figure, or to the lowest point which will permit adequate sealing of the catalyst stream sent to the regenerator.

Within the broad outlines discussed above, the following specific guidelines can be given for stripping conditions:

Superficial vapor velocities will usually be in the range of 0.25 to 4 fps, preferably 0.5 to 0.5 fps, and most preferably 0.75 to 1 fps.

Our preferred stripping gas is hydrogen, if available at low cost, and/or steam.

When hydrogen gas is used we prefer that at least some stripping with steam occur after hydrogen stripping. This minimizes the amount of hydrogen charged to the regenerator. Staged stripping, with hydrogen or light hydrocarbon gas added to an upper point in the stripper, and steam added to a lower point, is ideal.

Catalyst residence time in the stripper will usually be from 0.5 to 5 minutes, and preferably is 0.75 to 2.5 minutes.

CATALYST REGENERATION

The FCC unit may use any type of regenerator, ranging from single dense bed regenerators to the more modern, high efficiency designs. Some means to regenerate catalyst is essential, but the configuration of the regenerator is not.

Single, dense phase fluidized bed regenerators can be used, or multiple stage dense bed regenerators, or high efficiency regenerators such as the one shown in FIG. 2.

FCC REGENERATOR CONDITIONS

The temperatures, pressures, oxygen flow rates, etc., are within the broad ranges of those heretofore found suitable for FCC regenerators, especially those operating with substantially complete combustion of CO to CO2 within the regeneration zone. Suitable and preferred operating conditions are:

| | Broad | Preferred |
|---|---|---|
| Temperature, °F. | 1100–1700 | 1150–1400 |
| Catalyst Residence Time, Seconds | 60–3600 | 120–600 |
| Pressure, atmospheres | 1–10 | 2–5 |
| % Stoichiometric O2 | 100–120 | 100–105 |

CO COMBUSTION PROMOTER

Use of a CO combustion promoter in the regenerator is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. In swirl type regenerators, operation with 1 to 7 ppm Pt commonly occurs. Pt can be replaced by other metals, but usually more metal is then required. An amount of promoter giving a CO oxidation activity equal to 0.3 to 3 wt. ppm of platinum is preferred.

Catalyst coolers may be used, if desired. Such devices are very useful, especially when processing heavy feeds, but many units operate without them. In general, there will be less need for catalyst coolers when practicing our invention, because more efficient stripping of catalyst reduces the amount of fuel (unstripped hydrocarbons) that must be burned in the regenerator. Better stripping also reduces the steam partial pressure in the regenerator (by removing more of the hydrogen rich "fast coke" on spent catalyst in the stripper) so the catalyst can tolerate somewhat hotter regenerator temperatures. Thus, the regenerator will usually be able to operate cooler and dryer with an evacuated stripper, permitting higher temperature operation without excessive catalyst deactivation, so catalyst coolers will be harder to justify.

EXPERIMENTS

Several laboratory tests were run to determine the benefits of hydrogen stripping. The catalyst used was a clean burned E-cat from a commercial FCC unit. This catalyst was then coked, then stripped with different gases at different temperatures.

The feed was a 30:70 weight blend of LETGO and a sour heavy gas oil Catalyst loading was 7.5 g, with an il feed rate of 10 cc/min delivered by a syringe pump. Feed properties are shown in Table 1. Operating conditions are shown in Table 2.

TABLE 1

| Property | Feed Properties LETGO | HVGO | Blend |
|---|---|---|---|
| API | 36.3 | 23.5 | — |
| Spgr @ 60° F. | .8433 | .9154 | .8927* |
| Aniline Pt., °F. | 168 | 161 | — |
| Pour Pt, °F. | 25 | 80 | 70 |
| CCR, wt. % | .02 | .29 | .21* |
| Sulfur, wt. % | .13 | 2.07 | 1.49* |
| Total Nitrogen, wt. % | .02 | .151 | .11* |

TABLE 1-continued

| Property | Feed Properties LETGO | HVGO | Blend |
|---|---|---|---|
| Basic Nitrog., ppm | 36 | 417 | 303 |
| Refractive Index @ 70° C. | 1.45092 | 1.48925 | — |
| Distillation, D86 | | | |
| 5% | 483 | 538 | — |
| 10% | 494 | 592 | — |
| 50% | 550 | 752 | — |
| 90% | 643 | 946 | — |
| 95% | 686 | 992 | — |

*Calculated Properties

TABLE 2

| Operating Conditions | |
|---|---|
| Case: | 650 cc/min |
| Cracking Step | |
| Reaction Temp, °F. | 1000 |
| Charge Flow, cc/min | 10 |
| Reaction Time, sec | 60 |
| $N_2$ Flow, Diptube, cc/min | 100 |
| N2 Flow, Frit, cc/min | 180 |
| Purge Step | |
| Temperature, °F. | 1000 |
| Purge Time, sec | 26 |
| $H_2$ Flow, Diptube, cc/min | 100 |
| $H_2$ Flow, Frit, cc/min | 550 |
| Stripping Step | |
| Temperature, °F. | (see Table 3) |
| Time, total, sec | ~190 |
| $H_2$ Flow, Diptube, cc/min | 100 |
| $H_2$ Flow, Frit, cc/min | 550 |

Two cases were evaluated in this study, a base case using nitrogen as stripping gas (roughly equivalent to steam stripping) and hydrogen as stripping gas.

TABLE 3

Catalyst Coke Properties for 650 cc/min Stripping Medium

| | Catalyst: Base | Base | Base | Base | Base | Base |
|---|---|---|---|---|---|---|
| | Atmosphere: | | | | | |
| Stripping Temperature, °F. | $N_2$ | $H_2$ Coke, wt. % | $N_2$ | $H_2$ Sulfur, wt. % | $N_2$ | $H_2$ Nitrogen, ppm |
| 1000 | 1.130 | 1.067 | .073 | .050 | 290 | 280 |
| 1100 | 1.180 | .9157 | .065 | .056 | 280 | 230 |
| 1200 | 1.091 | .8974 | .097 | .033 | 280 | 220 |
| 1300 | 1.073 | .8438 | .086 | .053 | 260 | 180 |
| 1500 | 1.134 | .8455 | .070 | | 210 | |

Base Catalyst: Equilibrium Catalyst, M2GF2

DISCUSSION

Our invention demands an unusual stripping operation in which the stripper is largely or completely uncoupled from the reactor and some of the stripping vapor is recycled. We can use too much stripping steam, or the wrong kind of stripping vapor without adversely impacting the operation of the FCC main column, wet gas compressor, or gas plant.

The process and apparatus of the present invention allow refiners to improve the last great region of inefficiency remaining in FCC processing. Refiners have been plagued with strippers which left large amounts of potentially recoverable product on the spent catalyst, in some cases, ⅓ up to almost ½ of the "coke" was potentially recoverable product. Refiners now can make less coke, and more product, operate their units more efficiently, and without undue capital expense, and usually with no incremental operating expense.

The benefits are an immediate increase in the amount of liquid product recovered, a reduction in regenerator air blower duty, increased catalyst life due both to a cooler regenerator and to a drier regenerator, and increased conversion due to "winding up" the unit by increasing catalyst circulation to maintain a constant riser top temperature with cooler catalyst.

The invention also permits refiners to use stripping vapor selected from the group of hydrogen, a hydrogen rich gas, a C1–C2 stream derived from catalytically cracked products, and mixtures thereof, as at least a portion of the stripping vapor.

We claim:

1. A fluidized catalytic cracking process wherein a heavy hydrocarbon feed comprising hydrocarbons having a boiling point above about 650 F. is catalytically cracked to lighter products by contact with a circulating fluidizable catalytic cracking catalyst inventory consisting of particles having a size ranging from about 20 to about 100 microns, comprising:

a. catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons;

b. discharging said effluent mixture into a closed cyclone separation means within a reaction vessel to produce a cracked product rich vapor phase and a solids rich phase comprising spent catalyst;

c. removing said cracked product rich vapor phase from said vessel via a vapor transfer conduit passing through, and fluidly isolated from, a dilute phase, upper region of said reaction vessel;

d. discharging from said separation means a solids rich spent catalyst phase down into a stripping means in a lower portion of said reaction vessel; said stripping means having:

a hydrogen inlet in an upper portion thereof for hydrogen containing stripping gas, a steam inlet in a lower portion thereof for stripping steam, an outlet in a lower portion thereof for stripped catalyst, and an outlet in an upper portion thereof for stripper effluent vapor;

e. stripping said spent catalyst in said stripping means by contact with stripping vapor to produce stripper effluent vapor and stripped catalyst;

f. removing said stripper effluent vapor from said reactor vessel by a stripper effluent vapor transfer line connective with said dilute phase region of said reactor vessel;

g. recycling at least a portion of said stripper effluent vapor to said hydrogen inlet of said stripping means;

h. removing stripped catalyst from a lower portion of said stripping means and transporting said stripped catalyst via a catalyst transfer line to a catalyst regeneration means;

i. regenerating stripped catalyst in a catalyst regeneration means at catalyst regeneration conditions to produce regenerated catalyst; and j. recycling said regenerated catalyst from said regeneration means to said catalytic cracking reactor.

2. The process of claim 1 wherein said stripper effluent vapor has a dew point and contains steam, vaporized normally liquid hydrocarbons and normally gaseous materials, said effluent vapor passes through a heat removal means and is cooled to a temperature below its dew point and sufficient to condense most of the steam and normally liquid hydrocarbons to produce a three phase mixture of:

water, liquid hydrocarbons, and normally gaseous materials; and recycling at least a portion of said normally gaseous materials to said stripper.

3. The process of claim 2 wherein said stripper effluent vapor contains steam and hydrogen and produces a three phase mixture of water, liquid hydrocarbons, and vapor containing more than 25% hydrogen; and recycling at least a majority of said hydrogen containing vapor to said stripper.

4. The process of claim 1 wherein a steam jet ejector compresses vapor and discharges same into said hydrogen inlet of said stripper.

5. The process of claim 1 wherein at least 30 mole % of the stripping vapor is a recycled stream obtained from stripper effluent vapor.

6. The process of claim 1 wherein said stripper effluent vapor has a temperature above 900 F. and is cooled by heat exchange with water to produce steam having a pressure above 100 psig, and said produced steam is used in a steam jet ejector to recycle stripper vapor to said stripping means.

* * * * *